US007878182B2

(12) United States Patent
Yuen et al.

(10) Patent No.: US 7,878,182 B2
(45) Date of Patent: Feb. 1, 2011

(54) ENGINE EVAPORATIVE EMISSIONS CONTROL SYSTEM

(75) Inventors: Pui-Kei Yuen, Rochester Hills, MI (US); Andrew E. Buczynsky, Brownstown, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 12/433,968

(22) Filed: May 1, 2009

(65) Prior Publication Data

US 2010/0275888 A1 Nov. 4, 2010

(51) Int. Cl.
*F02M 33/02* (2006.01)

(52) U.S. Cl. ..... 123/520; 123/516

(58) Field of Classification Search ..... 123/516, 123/519, 520

See application file for complete search history.

(56) References Cited

U.S. PATENT DOCUMENTS

| | | | | |
|---|---|---|---|---|
| 6,474,319 | B1 * | 11/2002 | Hough et al. | 123/568.11 |
| 6,769,415 | B2 * | 8/2004 | Reddy et al. | 123/519 |
| 7,059,306 | B2 * | 6/2006 | Reddy | 123/518 |
| 7,159,577 | B2 * | 1/2007 | Haskew et al. | 123/516 |
| 7,284,530 | B2 * | 10/2007 | Nagasaki et al. | 123/198 D |
| 7,441,549 | B2 * | 10/2008 | Takayanagi | 123/520 |
| 7,484,501 | B2 * | 2/2009 | Amano et al. | 123/520 |
| 7,500,474 | B2 * | 3/2009 | Kano et al. | 123/520 |
| 7,647,920 | B2 * | 1/2010 | Amano et al. | 123/519 |
| 2002/0020398 | A1 * | 2/2002 | Kimoto et al. | 123/519 |
| 2004/0123845 | A1 * | 7/2004 | Nishioka et al. | 123/520 |
| 2005/0217645 | A1 * | 10/2005 | Fukaya et al. | 123/519 |
| 2005/0257608 | A1 * | 11/2005 | Suzuki | 73/118.1 |
| 2006/0065253 | A1 * | 3/2006 | Reddy | 123/520 |
| 2006/0185652 | A1 * | 8/2006 | Tsuge et al. | 123/519 |
| 2006/0225714 | A1 * | 10/2006 | Kano et al. | 123/520 |
| 2007/0107702 | A1 * | 5/2007 | King | 123/520 |
| 2008/0302339 | A1 * | 12/2008 | Krogull et al. | 123/516 |
| 2008/0308075 | A1 * | 12/2008 | Allen et al. | 123/519 |
| 2009/0159055 | A1 * | 6/2009 | Ohhira et al. | 123/519 |
| 2009/0194077 | A1 * | 8/2009 | Marushima et al. | 123/519 |
| 2009/0277427 | A1 * | 11/2009 | Yoshimura | 123/520 |
| 2009/0288645 | A1 * | 11/2009 | Childress et al. | 123/520 |

* cited by examiner

*Primary Examiner*—Hai H Huynh
(74) *Attorney, Agent, or Firm*—Harness, Dickey & Pierce, P.L.C.

(57) ABSTRACT

An evaporative emissions system may include a first passage selectively providing fluid communication between a fuel vapor region of a vehicle fuel reservoir and an engine air intake system, a second passage in fluid communication with the fuel vapor region and ambient air, and a filter assembly. The filter assembly may be impermeable to at least one of oxygen and hydrocarbons and may be located in the second passage between the fuel vapor region and ambient air. The filter assembly may prevent the at least one of oxygen and hydrocarbons from traveling between the fuel vapor region and ambient air.

20 Claims, 2 Drawing Sheets

ENGINE EVAPORATIVE EMISSIONS CONTROL SYSTEM

FIELD

Figure 1:
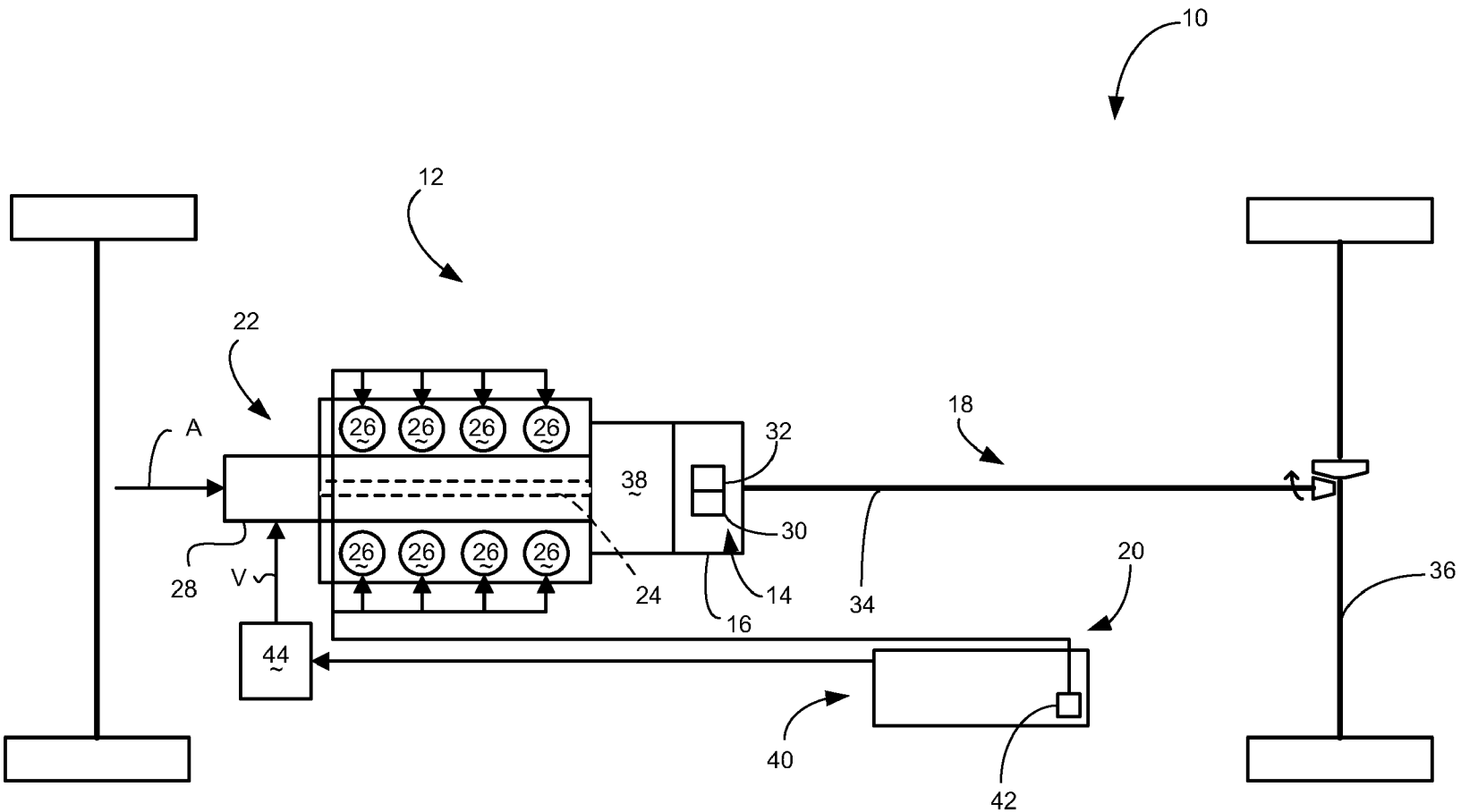

The present disclosure relates to internal combustion engines, and more specifically to evaporative emissions control systems for an internal combustion engine.

BACKGROUND

This section provides background information related to the present disclosure which is not necessarily prior art.

A vehicle typically includes a fuel tank that stores liquid fuel such as gasoline, diesel, methanol or other fuels. A portion of the liquid fuel in the fuel tank may evaporate into fuel vapor. An evaporative emissions control (EVAP) system is designed to store and dispose of fuel vapor to prevent and control unintended release into the atmosphere. For example, the EVAP system may return the fuel vapor from the fuel tank to the engine for combustion therein. Advanced plug-in hybrid vehicles may experience extended periods of time where engine operation is not required and turnover in the fuel tank is low. As a result, alternate venting arrangements may be used where the fuel tank is vented to atmosphere to control pressures within the fuel tank. Exposing the interior of the fuel tank to oxygen from ambient air may result in oxidation of the liquid fuel within the tank. Directly venting the fuel tank to the atmosphere may produce undesirable emissions as well as additional evaporation of liquid fuel within the fuel tank.

SUMMARY

An evaporative emissions system may include a first passage selectively providing fluid communication between a fuel vapor region of a vehicle fuel reservoir and an engine air intake system, a second passage in fluid communication with the fuel vapor region and ambient air, and a filter assembly. The filter assembly may be impermeable to at least one of oxygen and hydrocarbons and may be located in the second passage between the fuel vapor region and ambient air. The filter assembly may prevent the at least one of oxygen and hydrocarbons from traveling between the fuel vapor region and ambient air.

In another arrangement, an evaporative emissions system may include a solenoid actuated purge valve, a solenoid actuated diurnal control valve, a mechanical valve, and a filter assembly. The solenoid actuated purge valve may selectively provide fluid communication between a fuel vapor region of a vehicle fuel reservoir and an engine air intake system. The solenoid actuated diurnal control valve may selectively provide fluid communication between the fuel vapor region and ambient air. The mechanical valve may selectively provide fluid communication between the fuel vapor region and ambient air based on a pressure differential between the fuel vapor region and ambient air. The filter assembly may be in fluid communication with a fluid flow between the fuel vapor region and ambient air when the mechanical valve is opened and may be impermeable to at least one of oxygen and hydrocarbons. The filter assembly may prevent the at least one of oxygen and hydrocarbons from traveling between the fuel vapor region and ambient air when the mechanical valve is opened.

A hybrid vehicle evaporative emissions system may include a first passage, a second passage, and a filter assembly. The first passage may selectively provide fluid communication between a fuel vapor region of a vehicle fuel reservoir and an engine air intake system during a first operating mode of a hybrid vehicle where an engine propels the vehicle. The second passage may be in fluid communication with the fuel vapor region and ambient air. The filter assembly may be impermeable to at least one of oxygen and hydrocarbons. The filter assembly may be located in the second passage between the fuel vapor region and ambient air and may prevent the at least one of oxygen and hydrocarbons from traveling between the fuel vapor region and ambient air during a second operating mode of the hybrid vehicle where the engine is off and an electric motor propels the vehicle.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only and are not intended to limit the scope of the present disclosure in any way.

Figure 2:
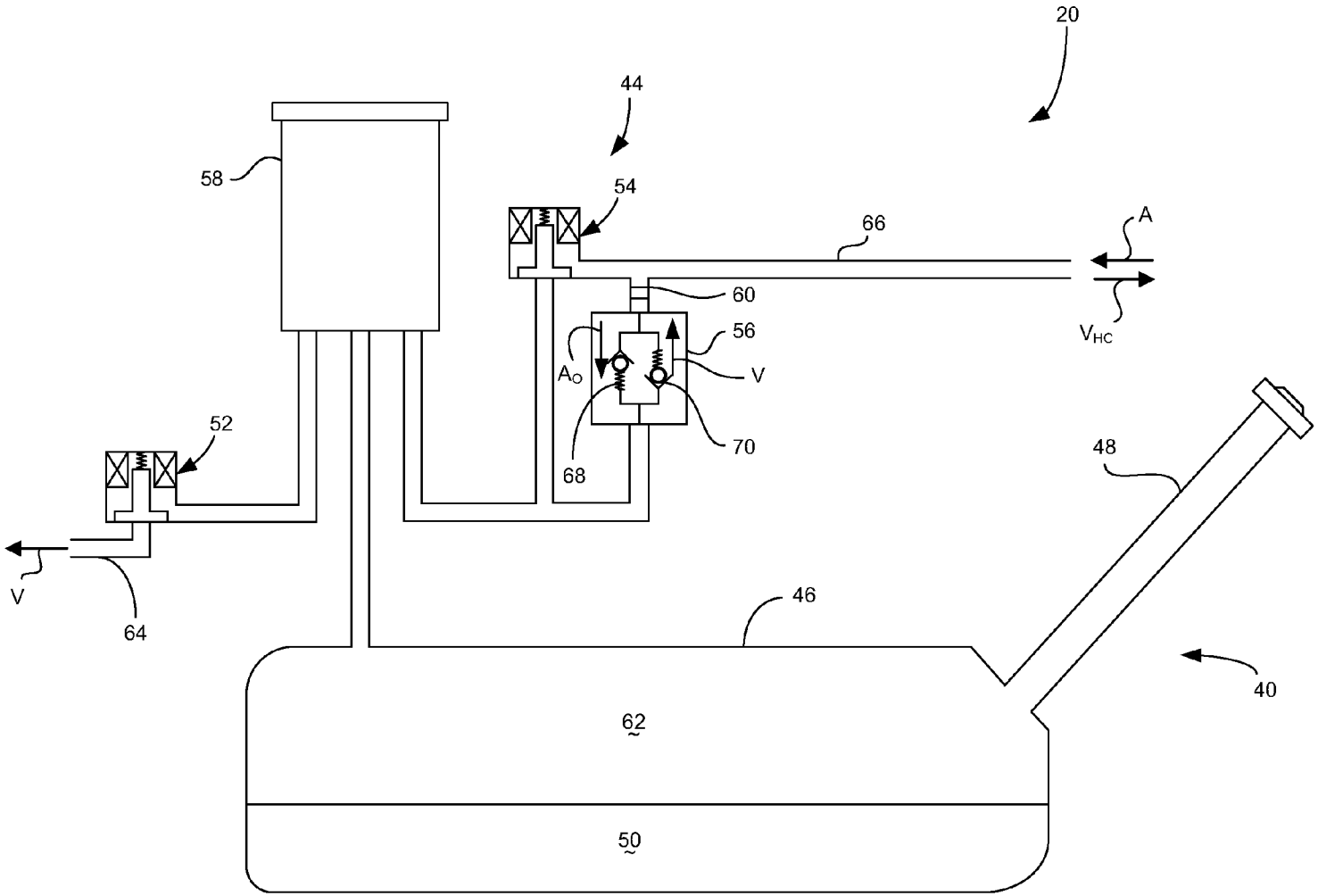

FIG. 1 is a schematic illustration of a vehicle according to the present disclosure; and FIG. 2 is a schematic illustration of the fuel system of the vehicle of FIG. 1.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Referring now to FIG. 1, an exemplary hybrid vehicle 10 is schematically illustrated. By way of non-limiting example, the vehicle 10 may include a plug-in hybrid vehicle. Vehicle 10 may include an engine assembly 12, a hybrid power assembly 14, a transmission 16, a driveline assembly 18, and a fuel system 20. The engine assembly 12 may include an internal combustion engine 22 having a crankshaft 24 rotationally driven by pistons 26 and an intake manifold 28 in fluid communication with ambient air flow (A). It is understood that the present disclosure applies to both Otto and Diesel cycle engines.

The hybrid power assembly 14 may include an electric motor 30 and a rechargeable battery 32. The electric motor 30 and the rechargeable battery 32 may form a drive mechanism for the hybrid power assembly 14. The motor 30 may be in electrical communication with the battery 32 to convert power from the battery 32 to mechanical power. The motor 30 may additionally be powered by the engine 22 and operated as a generator to provide power to charge the battery 32. The hybrid power assembly 14 may be incorporated into and engaged with the transmission 16.

The driveline assembly 18 may include an output shaft 34 and a drive axle 36. The motor 30 may be coupled to the output shaft 34 via the transmission 16 to power rotation of the drive axle 36. The engine 22 may be coupled to the transmission 16 via a coupling device 38. The coupling device 38 may include a friction clutch or a torque converter. The transmission 16 may use the power from the engine 22 and/or the motor 30 to drive the output shaft 34 and power rotation of the drive axle 36.

With additional reference to FIG. 2, the fuel system 20 may include a fuel tank assembly 40, a fuel pump 42 (FIG. 1), and an evaporative emissions (EVAP) system 44. The fuel tank assembly 40 may include a fuel reservoir 46 and a fill tube 48. The fuel reservoir 46 may contain liquid fuel. The fuel pump 42 may be in fluid communication with fuel contained in a liquid region 50 of the fuel reservoir 46 and may pressurize and provide the fuel to the engine 22.

EVAP system 44 may include first, second, and third valve assemblies 52, 54, 56, a canister assembly 58, and a filter assembly 60. The canister assembly 58 may include a charcoal canister in fluid communication with a vapor region 62 of the fuel reservoir 46. The first valve assembly 52 may form a purge valve including a first solenoid valve in fluid communication with the intake manifold 28 and the vapor region 62 and may selectively provide fluid communication between the intake manifold 28 and the vapor region 62 via a first passage 64. More specifically, the first valve assembly 52 may be located between the intake manifold 28 and the canister assembly 58 and may be in communication with the vapor region 62 via the canister assembly 58.

The second valve assembly 54 may form a diurnal control valve including a second solenoid valve in fluid communication with ambient air and the vapor region 62 and may selectively provide fluid communication between the ambient air and the vapor region 62 via a second passage 66. More specifically, the second valve assembly 54 may be located between the canister assembly 58 and ambient air and may be in communication with the vapor region 62 via the canister assembly 58. The third valve assembly 56 may also be in fluid communication with ambient air and the vapor region 62 and may selectively provide fluid communication between the ambient air and the vapor region 62 via a second passage 66.

The second and third valve assemblies 56 may form parallel flow paths between the ambient air and the vapor region 62. The third valve assembly 56 may include a mechanical valve assembly. By way of non-limiting example, the third valve assembly 56 may include first and second mechanical valves 68, 70. The first mechanical valve 68 may form a vacuum control valve. The first mechanical valve 68 may be normally biased to a closed position and may open when the pressure within the vapor region 62 is less than atmospheric pressure and a pressure differential between the ambient air (atmosphere) and the vapor region 62 exceeds a predetermined limit. The second mechanical valve 70 may form a pressure relief valve. The second mechanical valve 70 may be normally biased to a closed position and may open when the pressure within the vapor region 62 is greater than atmospheric pressure and a pressure differential between the ambient air (atmosphere) and the vapor region 62 exceeds a predetermined limit. The first and second mechanical valves 68, 70 may form parallel flow paths between the vapor region 62 and the ambient air (atmosphere).

The filter assembly 60 may be located between the vapor region 62 of the fuel reservoir 46 and the ambient air. The filter assembly 60 may be impermeable to both oxygen and hydrocarbons and may be permeable to other gases such as nitrogen. The filter assembly 60 may take a variety of forms. In the present non-limiting example, a single filter assembly 60 is illustrated between the third valve assembly 56 and the ambient air. However, it is understood that alternate arrangements may exist where the filter assembly 60 is located between the vapor region 62 of the fuel reservoir 46 and the third valve assembly 56. Further, it is understood that the filter assembly 60 may include first and second distinct filter elements (not shown), where the first is impermeable to oxygen and the second is impermeable to hydrocarbons.

By way of non-limiting example, the filter assembly 60 may include membranes, layers and sieves such as engineered zeolites, carbon molecular sieves, and/or inorganic metal complexes. Sizes and filtering capabilities of the various components of the filter assembly 60 may be specifically tailored for the molecular sizes of oxygen and hydrocarbons.

During operation, the vehicle 10 may be operable in a variety of modes depending on power requirements. In a first operating mode, the engine 22 may be decoupled from the transmission 16 and the electric motor 30 may drive the output shaft 34. The engine 22 may be off during the first mode. In a second operating mode, the crankshaft 24 may drive the output shaft 34 through combustion within the engine 22. In the second operating mode, the engine 22 may drive the output shaft 34 by itself or in combination with the electric motor 30. In a third operating mode, the engine 22 may drive the electric motor 30 to charge the battery 32 and may drive the output shaft 34.

During operation in the first mode, the first and second valve assemblies 52, 54 may be closed. During operation in the second mode, the first and second valve assemblies 52, 54 may be opened periodically based on engine operating conditions to provide the fuel vapor (V) from the vapor region 62 to the intake manifold 28 for combustion. The first valve assembly 52 may prevent fluid communication between the vapor region 62 and the intake manifold 28 when in the closed position. As indicated above, the second valve assembly 54 and the third valve assembly 56 may form parallel flow paths between the vapor region 62 and ambient air. When the second valve assembly 54 is closed, fluid flow between the vapor region 62 and the ambient air is controlled by the third valve assembly 56. The pressure within the vapor region 62 may fluctuate based on temperature and altitude.

During extended operating periods in the first mode, the pressure fluctuations may cause opening and closing of the third valve assembly 56 to control the pressure within the fuel reservoir 46. When the third valve assembly 56, and more specifically first mechanical valve 68, is opened to allow fluid flow into the fuel reservoir 46, ambient air flow (A) enters the second passage 66 and passes through the filter assembly 60. The filter assembly 60 prevents oxygen from the ambient air from entering the fuel reservoir. Therefore, the fluid flow ($A_O$) entering the fuel reservoir 62 may generally include ambient air without oxygen (i.e., nitrogen). Preventing the introduction of oxygen limits oxidation of the liquid fuel within the fuel reservoir 46 during the extended engine off times during operation in the first mode.

When the third valve assembly 56, and more specifically the second mechanical valve 70, is opened to allow fluid flow out of the fuel reservoir 46, the fuel vapor (V) also passes through the filter assembly 60. The filter assembly 60 prevents hydrocarbons from the vapor region 62 from escaping to the ambient air (atmosphere). Therefore, the fluid flow ($V_{HC}$) exiting the fuel reservoir 62 may generally include gases in the vapor region 62 without hydrocarbons. Preventing the escape of hydrocarbons limits evaporative losses to the atmosphere and maintains fuel vapor pressure in the fuel reservoir 62.

While discussed in combination with a hybrid vehicle 10, and more specifically a plug-in hybrid vehicle, it is understood that the present disclosure is not limited to hybrid applications and applies equally to vehicles powered solely by an internal combustion engine.

What is claimed is:

1. An evaporative emissions system including:

a first passage selectively providing fluid communication between a fuel vapor region of a vehicle fuel reservoir and an engine air intake system;

a second passage in fluid communication with the fuel vapor region and ambient air; and a filter assembly impermeable to oxygen located in the second passage between the fuel vapor region and ambient air and preventing oxygen from traveling between the fuel vapor region and ambient air.

2. The evaporative emissions system of claim 1, further comprising a purge valve located in the first passage and controlling fluid communication between the fuel vapor region and the engine air intake system.

3. The evaporative emissions system of claim 1, further comprising a valve assembly located in the second passage and controlling fluid communication between the fuel vapor region and ambient air.

4. The evaporative emissions system of claim 3, wherein the valve assembly includes a mechanical valve actuated between opened and closed positions by a pressure differential between the fuel vapor region and ambient air.

5. The evaporative emissions system of claim 3, wherein the valve assembly includes a pressure relief valve and the filter assembly is impermeable to hydrocarbons, the pressure relief valve allowing fluid flow from the fuel vapor region to the ambient air when in an opened position and the filter assembly preventing hydrocarbons from leaving the fuel vapor region when the pressure relief valve is in the opened position.

6. The evaporative emissions system of claim 3, wherein the valve assembly includes a vacuum control valve allowing fluid flow from the ambient air to the fuel vapor region when in an opened position and the filter assembly prevents oxygen from entering the fuel vapor region when the vacuum control valve is in the opened position.

7. The evaporative emissions system of claim 3, wherein the valve assembly allows fluid flow from the fuel vapor region to the ambient air during a first condition and allows fluid flow from the ambient air to fuel vapor region during a second condition, the filter assembly being impermeable to both oxygen and hydrocarbons and preventing hydrocarbons from leaving the fuel vapor region during the first condition and preventing oxygen from entering the fuel vapor region during the second condition.

8. The evaporative emissions system of claim 3, further comprising a first solenoid operated valve located in the first passage and controlling fluid communication between the fuel vapor region and the engine air intake system and a second solenoid operated valve located in the second passage, the second solenoid operated valve and the valve assembly forming parallel flow paths and controlling fluid communication between the fuel vapor region and the ambient air.

9. The evaporative emissions system of claim 8, wherein the valve assembly controls fluid flow exiting the fuel vapor region when the first and second valves are closed, the fluid flow exiting the fuel vapor region passing through the filter assembly before exiting the evaporative emissions system.

10. The evaporative emissions system of claim 1, wherein the filter assembly is permeable to nitrogen.

11. An evaporative emissions system including:

a solenoid actuated purge valve selectively providing fluid communication between a fuel vapor region of a vehicle fuel reservoir and an engine air intake system;

a solenoid actuated diurnal control valve selectively providing fluid communication between the fuel vapor region and ambient air;

a mechanical valve selectively providing fluid communication between the fuel vapor region and ambient air based on a pressure differential between the fuel vapor region and ambient air; and a filter assembly in fluid communication with a fluid flow between the fuel vapor region and the ambient air when the mechanical valve is opened and impermeable to at least one of oxygen and hydrocarbons to prevent the at least one of oxygen and hydrocarbons from traveling between the fuel vapor region and ambient air.

12. The evaporative emissions system of claim 11, wherein the mechanical valve forms a pressure relief valve and controls fluid flow exiting the fuel vapor region when the first and second valves are closed, the fluid flow exiting the fuel vapor region passing through the filter assembly to prevent hydrocarbons from exiting the fuel vapor region.

13. The evaporative emissions system of claim 11, wherein the mechanical valve forms a vacuum control valve and controls fluid flow entering the fuel vapor region when the first and second valves are closed, the fluid flow entering the fuel vapor region passing through the filter assembly to prevent oxygen from entering the fuel vapor region.

14. A hybrid vehicle evaporative emissions system comprising:

a first passage selectively providing fluid communication between a fuel vapor region of a vehicle fuel reservoir and an engine air intake system during a first operating mode of a hybrid vehicle where an engine propels the vehicle;

a second passage in fluid communication with the fuel vapor region and ambient air; and a filter assembly impermeable to oxygen located in the second passage between the fuel vapor region and ambient air and preventing oxygen from traveling between the fuel vapor region and ambient air during a second operating mode of the hybrid vehicle where the engine is off and an electric motor propels the vehicle.

15. The hybrid vehicle evaporative emissions system of claim 14, further comprising a solenoid actuated purge valve selectively providing fluid communication between the fuel vapor region and the engine air intake system via the first passage.

16. The hybrid vehicle evaporative emissions system of claim 15, further comprising a solenoid actuated diurnal control valve selectively providing fluid communication between the fuel vapor region and ambient air via the second passage.

17. The hybrid vehicle evaporative emissions system of claim 16, further comprising a mechanical valve selectively providing fluid communication between the fuel vapor region and ambient air based on a pressure differential between the fuel vapor region and ambient air, the diurnal control valve and the mechanical valve forming parallel flow paths between the fuel vapor region and ambient air, the filter assembly being in fluid communication with a fluid flow between the fuel vapor region and ambient air when the mechanical valve is opened.

18. The hybrid vehicle evaporative emissions system of claim 17, wherein the mechanical valve forms a vacuum control valve and the filter assembly prevents oxygen from entering the fuel reservoir during the second operating mode.

19. The hybrid vehicle evaporative emissions system of claim 17, wherein the filter assembly is impermeable to hydrocarbons and the mechanical valve forms a pressure relief valve, the filter assembly preventing hydrocarbons from exiting the fuel reservoir during the second operating mode.

20. The hybrid vehicle evaporative emissions system of claim 17, wherein the purge valve and the diurnal control valve are both closed during the second operating mode.

* * * * *